US009577336B2

(12) United States Patent
Ying

(10) Patent No.: US 9,577,336 B2
(45) Date of Patent: Feb. 21, 2017

(54) INVERTED-F ANTENNA WITH A CHOKE NOTCH FOR WIRELESS ELECTRONIC DEVICES

(71) Applicant: Sony Corporation, Tokyo (JP)

(72) Inventor: Zhinong Ying, Lund (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 273 days.

(21) Appl. No.: 14/529,397

(22) Filed: Oct. 31, 2014

(65) Prior Publication Data

US 2016/0126632 A1 May 5, 2016

(51) Int. Cl.

| | |
|---|---|
| ***H01Q 1/24*** | (2006.01) |
| ***H01Q 9/04*** | (2006.01) |
| ***H01Q 1/48*** | (2006.01) |
| ***H01Q 9/28*** | (2006.01) |
| ***H01Q 9/42*** | (2006.01) |
| *H01Q 1/52* | (2006.01) |
| *H01Q 21/08* | (2006.01) |

(52) U.S. Cl.

CPC ..... *H01Q 9/045* (2013.01); *H01Q 1/243* (2013.01); *H01Q 1/48* (2013.01); *H01Q 9/285* (2013.01); *H01Q 9/42* (2013.01); *H01Q 1/523* (2013.01); *H01Q 21/08* (2013.01)

(58) Field of Classification Search

CPC ..... H01Q 9/38; H01Q 9/44; H01Q 1/48; H01Q 1/243; H01Q 9/045; H01Q 9/285; H01Q 1/523; H01Q 21/08; H01Q 9/42

USPC ..... 343/700 MS, 702, 829, 846

See application file for complete search history.

(56) References Cited

U.S. PATENT DOCUMENTS

| | | | | |
|---|---|---|---|---|
| 7,081,854 | B2 * | 7/2006 | Ying | H01Q 1/243 343/700 MS |
| 7,456,792 | B2 * | 11/2008 | Baliarda | H01Q 1/241 343/700 MS |
| 8,502,739 | B2 * | 8/2013 | Ollikainen | H01Q 1/243 343/702 |
| 9,124,000 | B2 * | 9/2015 | Wang | H01Q 1/48 |
| 2008/0316115 | A1 * | 12/2008 | Hill | H01Q 1/243 343/702 |
| 2009/0174611 | A1 * | 7/2009 | Schlub | H01Q 1/243 343/702 |
| 2010/0214180 | A1 * | 8/2010 | Krogerus | H01Q 1/243 343/702 |
| 2011/0205138 | A1 * | 8/2011 | Yanagi | H01Q 9/42 343/845 |

* cited by examiner

*Primary Examiner* — Tho G Phan

(74) *Attorney, Agent, or Firm* — Myers Bigel, P.A.

(57) ABSTRACT

A wireless electronic device includes an inverted-F antenna (IFA) having an IFA exciting element, an IFA feed, and a grounding pin. The IFA exciting element is configured to resonate at a resonant frequency when excited by a signal received through the IFA feed. The wireless electronic device includes a choke notch having a length defined based on the resonant frequency of the IFA exciting element. The choke notch is electrically coupled to the IFA exciting element through the grounding pin. A ground patch is electrically coupled between the choke notch and the ground plane.

16 Claims, 10 Drawing Sheets

INVERTED-F ANTENNA WITH A CHOKE NOTCH FOR WIRELESS ELECTRONIC DEVICES

TECHNICAL FIELD

The present inventive concepts generally relate to the field of wireless communications and, more specifically, to antennas for wireless communication devices.

BACKGROUND

Wireless communication devices such as cell phones and other user equipment may include antennas that can be used to communicate with external devices. These antennas may produce different types of radiation patterns in the proximity of the communication device. Some antenna designs, however, may facilitate undesirable amounts of ground currents and irregular radiation patterns.

SUMMARY

Various embodiments of the present inventive concepts include a wireless electronic device including an inverted-F antenna (IFA). The IFA may include an IFA exciting element, an IFA feed, and a grounding pin. The IFA exciting element may be configured to resonate at a resonant frequency when excited by a signal received through the IFA feed. The wireless electronic device may include a choke notch having a length defined based on the resonant frequency of the IFA exciting element. The choke notch may be electrically coupled to the IFA exciting element through the grounding pin. A ground patch may be electrically coupled between the choke notch and a ground plane.

According to various embodiments, the length of the choke notch may correspond to approximately 0.5 wavelengths of the resonant frequency of the IFA exciting element. The IFA feed may be located near the center of the choke notch, at approximately 0.25 wavelengths of the resonant frequency of the IFA. The IFA feed may be located near the ground patch. The ground patch may be electrically connected to the choke notch near the center of the choke notch.

In various embodiments, a feeding point on the IFA feed may be electrically connected to the IFA by a via contact. The IFA feed may include a conductive stripline. The width of the IFA feed on a printed circuit board (PCB) layer may be selected based on the thickness of the PCB layer such that the IFA is impedance matched to the IFA exciting element. The IFA exciting element, the grounding pin, the choke notch, the ground patch, and the ground plane may be collocated on a first layer of a printed circuit board (PCB). The IFA feed may be located on a second layer, different from the first layer, of the PCB.

In some embodiments, the IFA may be configured to induce current on the choke notch such that a radiation pattern of the wireless electronic device forms a dipole antenna pattern. The choke notch may be configured to prevent current loops on the ground plane. The length of the ground patch may be between 0.1 and 0.2 wavelengths. The length of the ground patch may determine the bandwidth of the choke notch. The grounding pin may be electrically conductive and may be impedance matched to the IFA exciting element.

According to various embodiments, the resonant frequency may be a first resonant frequency. The choke notch may be configured to resonate at a second resonant frequency, different from the first resonant frequency.

In some embodiments, the IFA may include a first IFA. One or more additional IFAs, each including an additional IFA exciting element, an additional IFA feed, an additional grounding pin, and an additional choke notch that is electrically coupled to the additional IFA through the additional grounding pin may be included in the wireless electronic device. The first IFA and the one or more additional IFAs may be along an edge of a mobile device.

According to various embodiments, spacing between adjacent ones of the choke notches may be between 0.25 wavelengths and 0.5 wavelengths. In some embodiments, the spacing between adjacent ones of the choke notches may be about 0.45 wavelengths.

In various embodiments, the one or more additional IFAs may include three additional IFAs. The first IFA and the three additional IFA may be configured to receive and/or transmit multiple-input and multiple-output (MIMO) communication. The length of the choke notch may approximately 0.5 wavelengths of the IFA exciting element. The IFA feed may be located near the center of the choke notch, at approximately 0.25 of the wavelength of the IFA. The choke notch may be configured to prevent current loops on the ground plane.

Various embodiments of the present inventive concepts include a wireless electronic device including a plurality of inverted-F antennas (IFAs), each comprising an IFA exciting element, an IFA feed, and a grounding pin. The IFA exciting element may be configured to resonate at a resonant frequency when excited by a signal received through the IFA feed. The wireless electronic device may include a plurality of choke notches that are each electrically coupled to a respective one of the plurality of IFAs through a respective grounding pin. The length of one of the plurality of choke notches may be based on the resonant frequency of the respective IFA exciting element. The plurality of IFAs may be along an edge of a mobile device.

Various embodiments of the present inventive concepts include a wireless electronic device including a ground plane, a ground patch that protrudes from an end of the ground plane, a choke notch that extends from an end of the ground patch that is remote from the ground plane and extends approximately parallel to the end of the ground plane, and a grounding pin that extends from the choke notch. The wireless electronic device may include an IFA exciting element that extends from an end of the grounding pin remote from the choke notch and extends approximately parallel to the choke notch. The wireless electronic device may include an IFA feed extending from the IFA exciting element. In some embodiments, the IFA exciting element, the grounding pin, the choke notch, the ground patch, and the ground plane may be collocated on a first layer of a printed circuit board (PCB). The IFA feed may be located on a second layer, different from the first layer, of the PCB.

Other devices and/or operations according to embodiments of the inventive concept will be or become apparent to one with skill in the art upon review of the following drawings and detailed description. It is intended that all such additional devices and/or operations be included within this description, be within the scope of the present inventive concept, and be protected by the accompanying claims. Moreover, it is intended that all embodiments disclosed herein can be implemented separately or combined in any way and/or combination.

DETAILED DESCRIPTION

Figure 1:
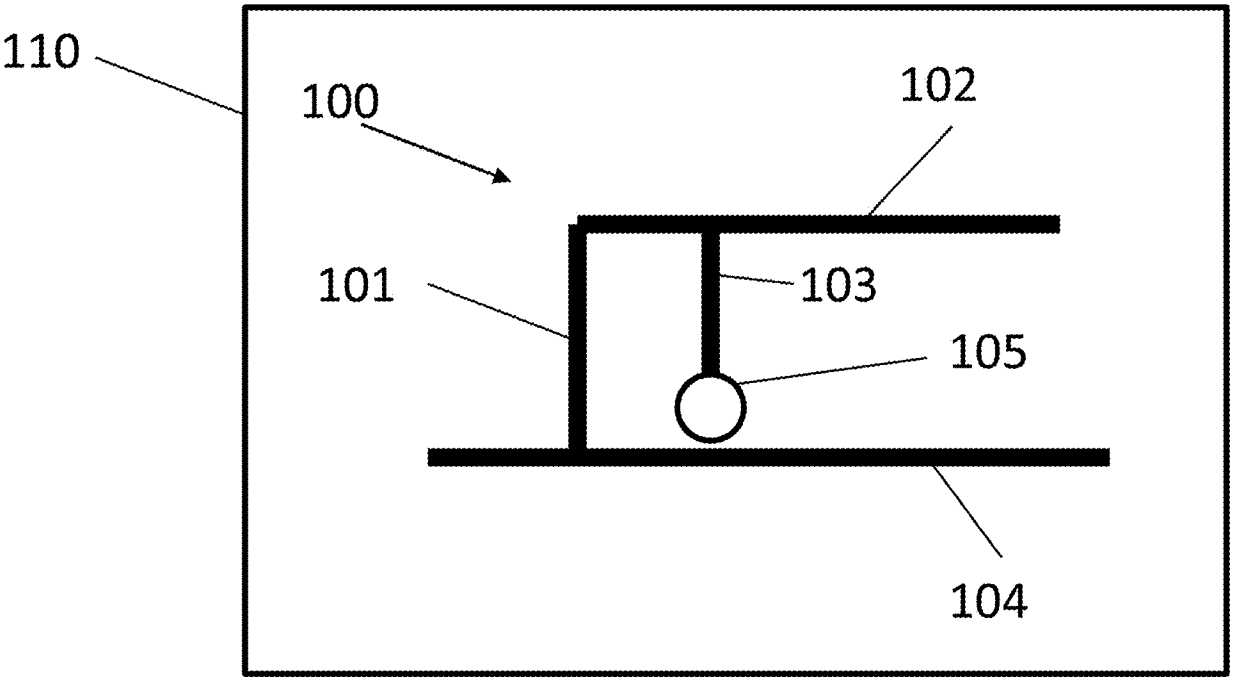
FIG. 1 illustrates an inverted-F antenna (IFA) of a wireless electronic device.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly-formal sense unless expressly so defined herein.

An inverted-F antenna (IFA) is commonly used in microwave antenna designs for mobile terminals. IFA designs may be compact in size and easy to manufacture since they may be implemented as edge printed features on printed circuit boards (PCBs). Various wireless communication applications may use an array of IFAs. A disadvantage of IFA designs may be the presence of ground currents in the ground plane. These ground currents may cause higher radiation coupling between antenna array elements and may induce irregular radiation patterns. Higher coupling between antenna array elements and irregular radiation patterns may not be suitable for extremely high frequency (EHF) radio antenna applications such as millimeter wave antenna arrays for use in the 10 to 300 GHz frequency range. These millimeter wave frequencies may be used for various types of communication in smart phones such as broadband internet access, Wi-Fi, etc. Moreover, array antennas may narrow the radiation pattern into a beam that is directional and may require the device to be directed towards the base station.

The inverted-F antenna design may be improved by adding a choke notch that is impedance matched to the IFA exciting element of the IFA. The choke notch may prevent, stop, and/or reduce ground currents in the ground plane, thus improving radiation patterns by reducing lobes and distortion. The IFA with a choke notch may exhibit good polarization characteristics with a broad radiation beam that is substantially symmetric with wide scanning angles.

Referring now to FIG. 1, the diagram illustrates an inverted-F antenna (IFA) 100 of a wireless electronic device 110. The IFA 100 includes an IFA exciting element 102, an IFA feed 103, a ground plane 104, and a grounding pin 101. The end of the IFA feed 103 may include a test point 105. The IFA feed 103 may be a stripline. The stripline may include an electrically conductive material. In some embodiments, the stripline may include a matching network including one or more inductors, capacitors, and/or resistors. A signal received at the IFA feed 103 and/or a signal injected at the test point 105 may excite the IFA exciting element 102.

Figure 2:
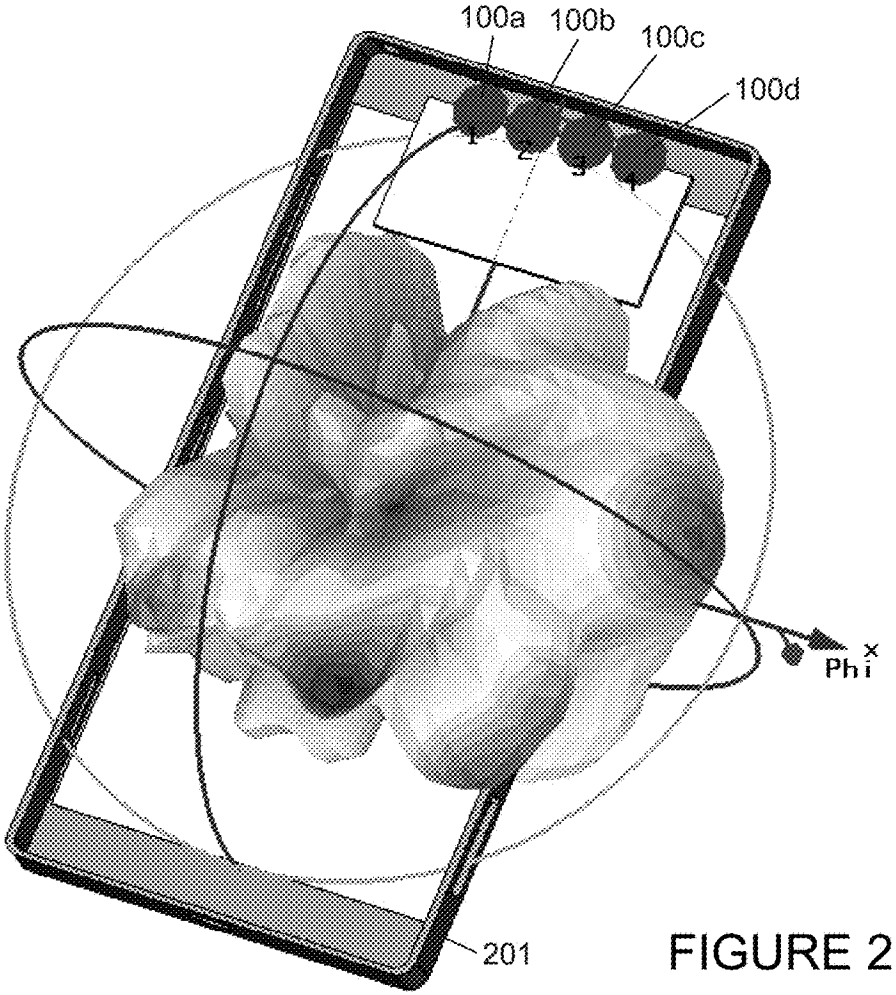
FIG. 2 illustrates the radiation pattern around a wireless electronic device such as a smartphone, including the inverted-F antenna of FIG. 1, according to various embodiments of the present inventive concepts.

Referring now to FIG. 2, the radiation pattern around a mobile device 201 including an array of the inverted-F antennas of FIG. 1 is illustrated. An array of IFAs, 100*a*, 100*b*, 100*c*, and 100*d* are included along an edge of mobile device 201. When the IFAs 100*a*-100*d* are excited at 100 GHz, an irregular radiation pattern is formed around the mobile device 201. The radiation pattern around the mobile device 201 includes irregular lobes and distortion that is not suitable for communication at this frequency.

The radiation pattern formed by the array of inverted-F antennas of FIG. 1 may be acceptable at lower frequencies such as, for example, in the cellular band of 850 to 1900 MHz. However, distortion with many irregular lobes may occur at millimeter band radio frequencies in the electromagnetic spectrum from 10 to 300 GHz, as illustrated in FIG. 2.

Figure 3:
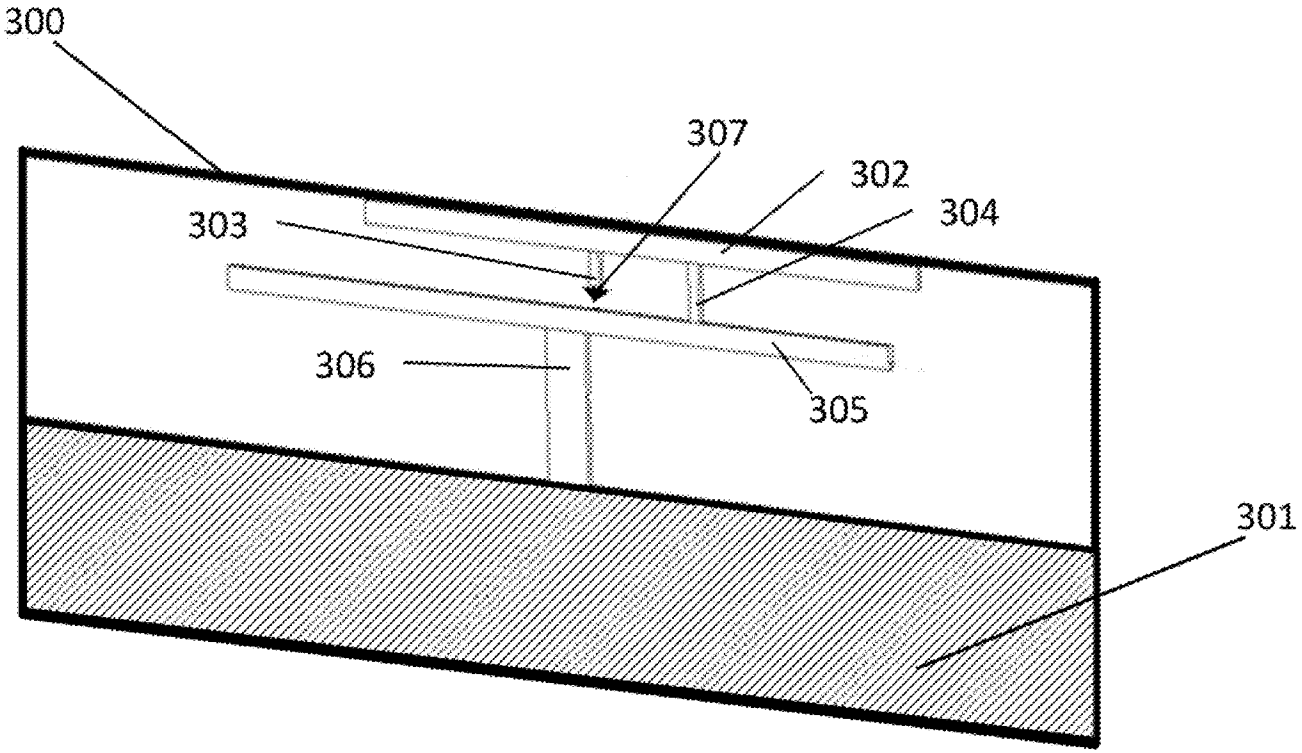
FIG. 3 illustrates an IFA including a choke notch, according to various embodiments of the present inventive concepts.

Referring now to FIG. 3, an inverted-F antenna (IFA) 300 including a choke notch 305 according to various embodiments of the invent concepts is illustrated. An IFA exciting element 302 may be excited by a signal received through an IFA feed 303. The IFA feed 303 may be connected at one end to a test point 307. Signals may be introduced at the test point 307 to excite the IFA exciting element 302. The IFA feed 303 may be coupled to a transceiver for sending and receiving communication signals. The IFA exciting element 302 may be electrically connected by a grounding pin 304 to a choke notch 305. The grounding pin 304 may be electrically conductive and may be sized to impedance match the IFA exciting element. Impedance matching may be desirable for reducing mismatch losses to minimize reflections of signals, thereby reducing distortion in the radiation pattern of the IFA 300.

Still referring to FIG. 3, in some embodiments, the choke notch 305 may be approximately parallel to the IFA exciting element 302. The choke notch 305 may be electrically connected to the ground plane 301 by a ground patch 306. The length of the choke notch 305 may correspond to approximately 0.5 wavelengths of the resonant frequency of the IFA exciting element 302. The IFA feed 303 may be located near the center of the choke notch 305, at approximately 0.25 wavelengths of the resonant frequency of the IFA exciting element 302. In other words, an edge mounted IFA may be built on a balanced 0.25 wavelength choke notch. The length of the ground patch 306 may be 0.1 to 0.2 wavelengths of the resonant frequency of the IFA exciting element 302. The length of the ground patch 306 may determine the signal bandwidth supported by the choke notch 305. Reducing the length of the ground patch 306 may reduce the signal bandwidth supported by the choke notch 305. In some embodiments, the width of the ground patch 306 is greater than the width of the IFA feed 303.

The choke notch 305 may prevent, stop, and/or reduce current and/or current loops on the ground plane. When excited by a signal at the IFA feed 303, a current may be induced on the choke notch 305, forming a dipole mode on the choke notch 305. A dipole mode may be a magnetic dipole based on a closed circulation of current. The collective structure including the choke notch 305 may thus behave as a dipole antenna. More specifically, the IFA 300 may be configured to induce current on the choke notch 305 such that a radiation pattern of the wireless electronic device forms a dipole antenna pattern. The IFA exciting element 302 may be configured to resonate at a first resonant frequency, whereas the choke notch 305 may be configured to resonate at a second resonant frequency that is different from the first resonant frequency. Coupling of radiation patterns related to the first and second resonant frequencies may result in the dipole antenna pattern.

Figure 4:
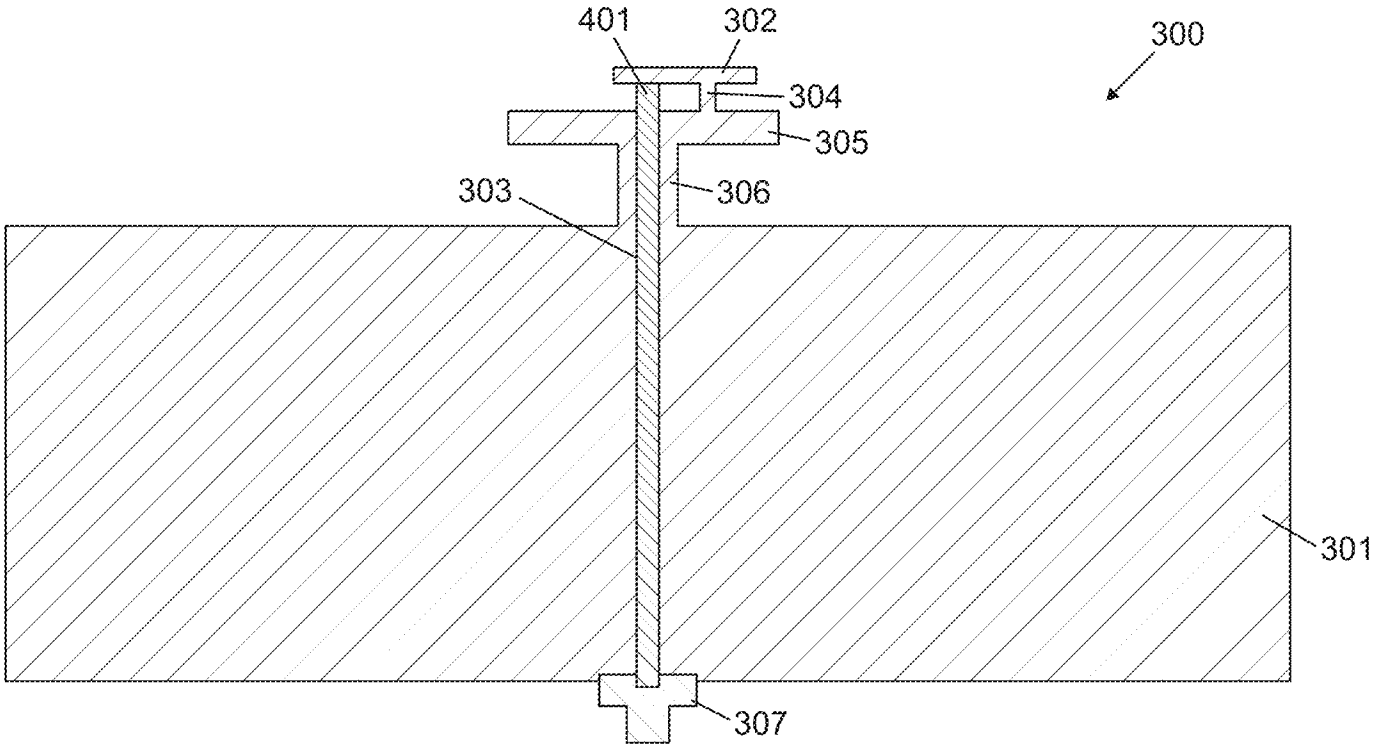
FIG. 4 illustrates a plan view of an IFA including a choke notch, according to various embodiments of the present inventive concepts.

Referring now to FIG. 4, a plan view of the IFA 300 of FIG. 3 is illustrated. The IFA exciting element 302 may be excited by a signal received through the IFA feed 303. A test point 307 may be connected to one end of the IFA feed 303. A via contact 401 may electrically connect the IFA feed 303 to the IFA exciting element 302. The IFA exciting element 302 may be electrically connected by a grounding pin 304 to a choke notch 305, that is substantially parallel to the IFA exciting element 302. The choke notch 305 may be electrically connected to the ground plane 301 through a ground patch 306. The IFA exciting element 302, the grounding pin 304, choke notch 305, the ground patch 306, and the ground plane 301 may be collocated on a first layer of a printed circuit board (PCB). The IFA feed 303 may be located on a second layer, different from the first layer of the PCB. The via contact 401 may electrically connect the IFA feed 303 to the IFA exciting element 302 between the layers of the PCB. The IFA feed 303 may be located near the ground patch 306. In some embodiments, the IFA feed 303 may be directly above the ground patch 306 and/or may be centered on the ground patch 306. In some embodiments, the IFA feed 303 may not be connected to the choke notch 305.

In some embodiments, the ground patch 306 may be greater in width than the IFA feed 303, such that the IFA feed 303 on a first layer of the PCB overlaps the ground patch 306 on a second, different layer of the PCB. In some embodiments described herein, the width of the IFA feed 303 on the PCB layer may be selected based on the thickness of the PCB layer such that the IFA feed 303 is impedance matched to the IFA exciting element 302.

Figure 5:
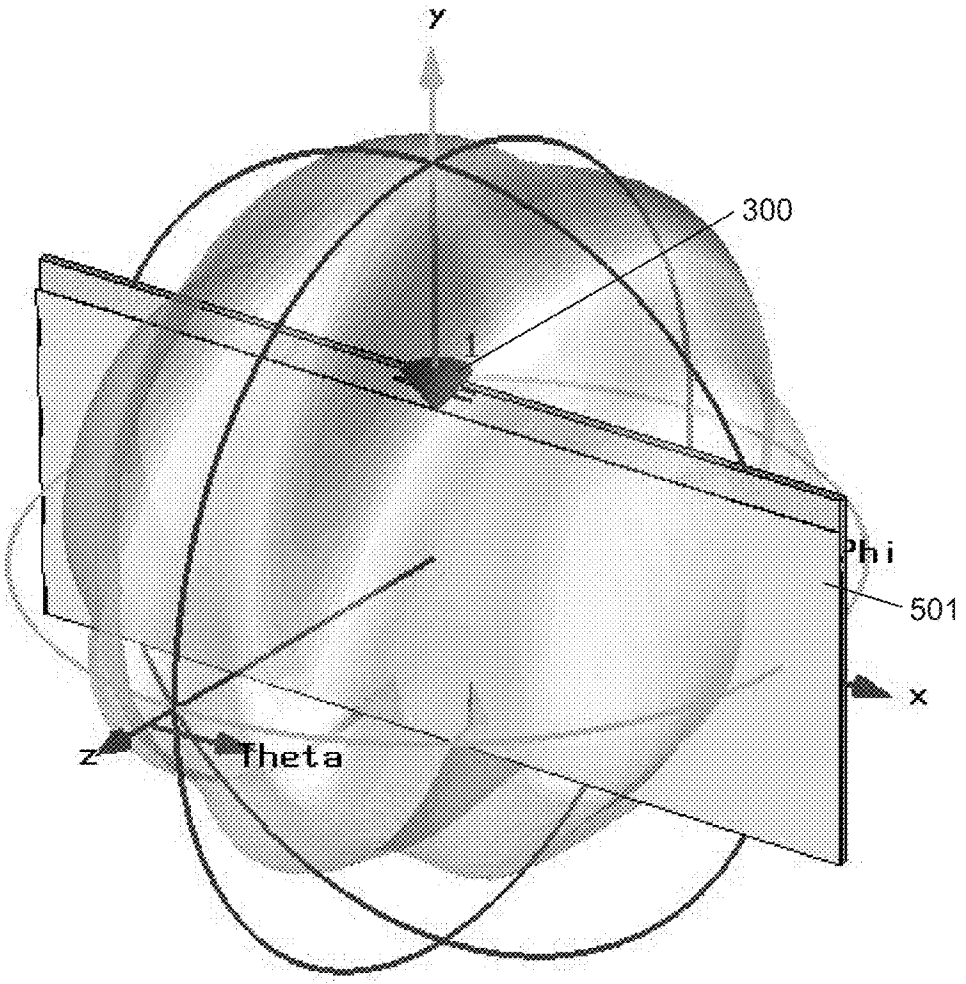
FIG. 5 illustrates the radiation pattern around a wireless electronic device including the IFA with a choke notch of FIGS. 3 and/or 4, according to various embodiments of the present inventive concepts.

Referring now to FIG. 5, the radiation pattern around the wireless electronic device 501 that includes the IFA 300 with a choke notch of FIGS. 3 and/or 4 is illustrated. The radiation pattern of the IFA 300 spans broadly and uniformly around the wireless electronic device 501, when compared to the radiation pattern of the IFA without the choke notch, as illustrated in FIG. 2. The radiation pattern of the IFA 300 with the choke notch may be similar to a dipole antenna pattern, as discussed above with respect to FIG. 3.

Figure 6:
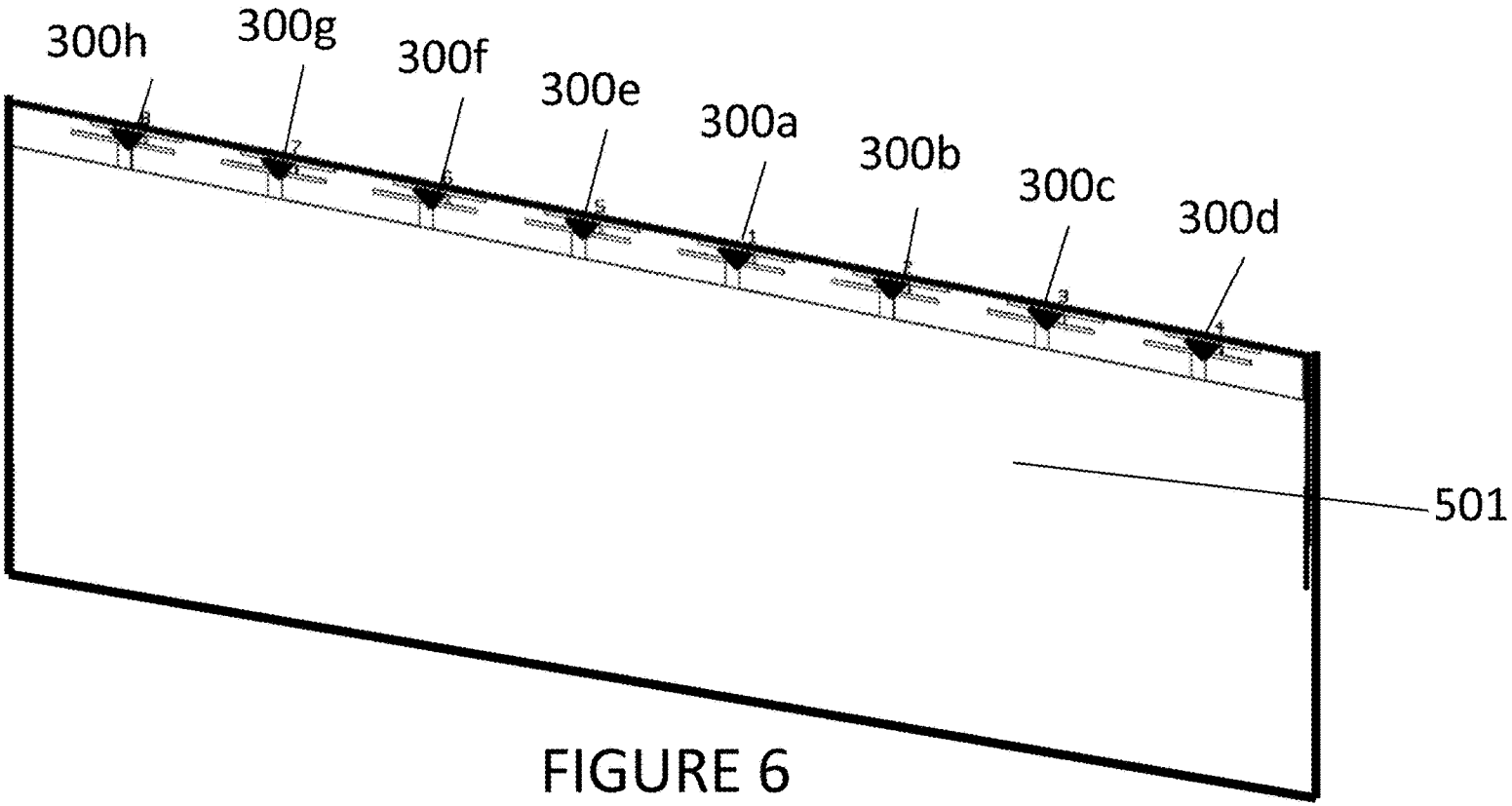
FIG. 6 illustrates a wireless electronic device with an array of IFAs with choke notches as in FIGS. 3 and/or 4 along the edge of the wireless electronic device, according to various embodiments of the present inventive concepts.

Referring now to FIG. 6, a wireless electronic device 501 with an array of IFAs 300*a*-300*h* as in FIGS. 3 and/or 4 along the edge of the wireless electronic device 501 is illustrated. Each of the IFAs 300*a*-300*h* may include an IFA exciting element 302, a grounding pin 304, a choke notch 305, a ground patch 306, and a IFA feed 303, as illustrated in FIGS. 3 and/or 4. Each of the IFAs 300*a*-300*h* may be electrically coupled to the ground plane 301, as illustrated in FIG. 3. In some embodiments, a common ground may be shared between two or more IFAs 300*a*-300*h*. Spacing between adjacent choke notches may be between 0.25 and 0.5 wavelengths, measured from tip-to-tip of the choke notches and/or from center-to-center of the choke notches. In some embodiments, the spacing between adjacent choke notches may be 0.45 wavelengths.

Still referring to FIG. 6, in some embodiments, the IFAs 300*a*-300*h* may include two arrays of four IFAs each. For example, IFAs 300*a*-300*d* may be one array while IFAs 300*e*-300*h* may be a second array. The first and second arrays may each function independently as a receive antenna and/or a transmit antenna. In some embodiments, the array of IFAs 300 may include four IFAs 300 and may be configured to receive and/or transmit multiple-input and multiple output (MIMO) communication.

Figure 7:
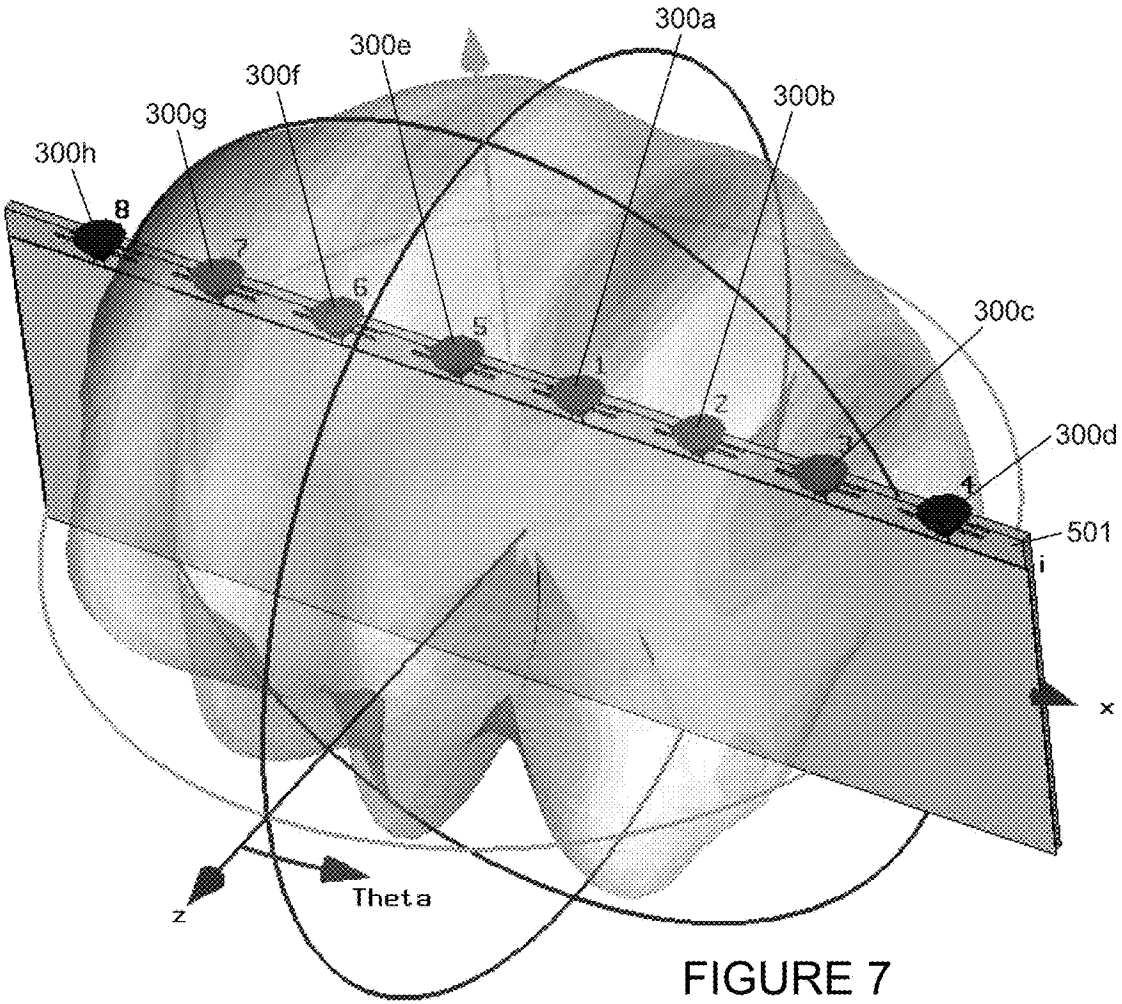
FIG. 7 illustrates the radiation pattern around the wireless electronic device of FIG. 6, according to various embodiments of the present inventive concepts.

Referring now to FIG. 7, the radiation pattern around a wireless electronic device 501 with the array of IFAs 300*a*-300*h* of FIG. 6 is illustrated. The radiation pattern of the array of IFAs 300*a*-300*h* spans broadly and uniformly around the wireless electronic device 501, with little distortion and/or low radiation coupling between array elements. The radiation pattern may also exhibit good polarization characterization (i.e. orientation) with respect to the wireless electronic device 501 with a broad radiation beam. The radiation pattern is also substantially symmetric such that the array of IFAs has wide scanning angles in applications for receiving and/or transmitting signals.

Figure 8:
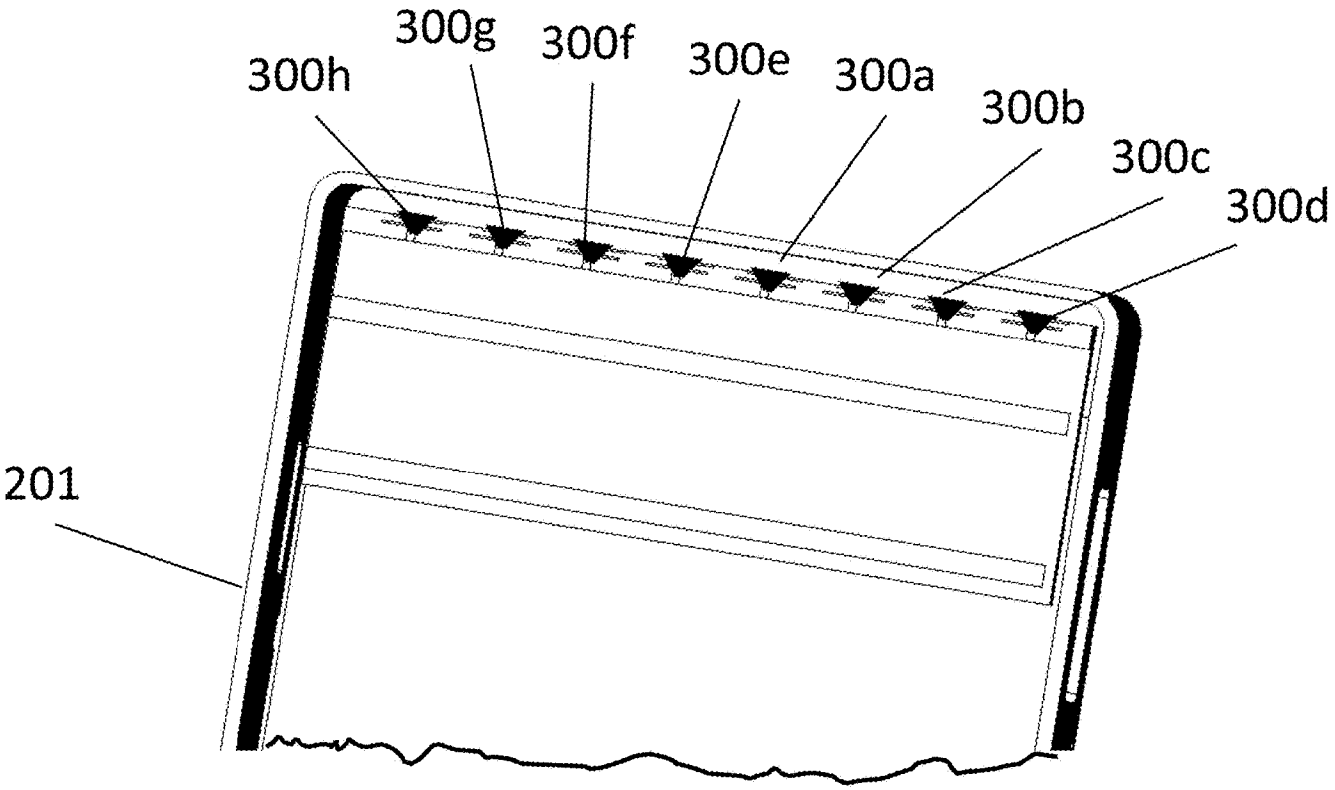
FIG. 8 illustrates an array of IFAs with choke notches along an edge of a mobile device, according to various embodiments of the present inventive concepts.
Figure 9:
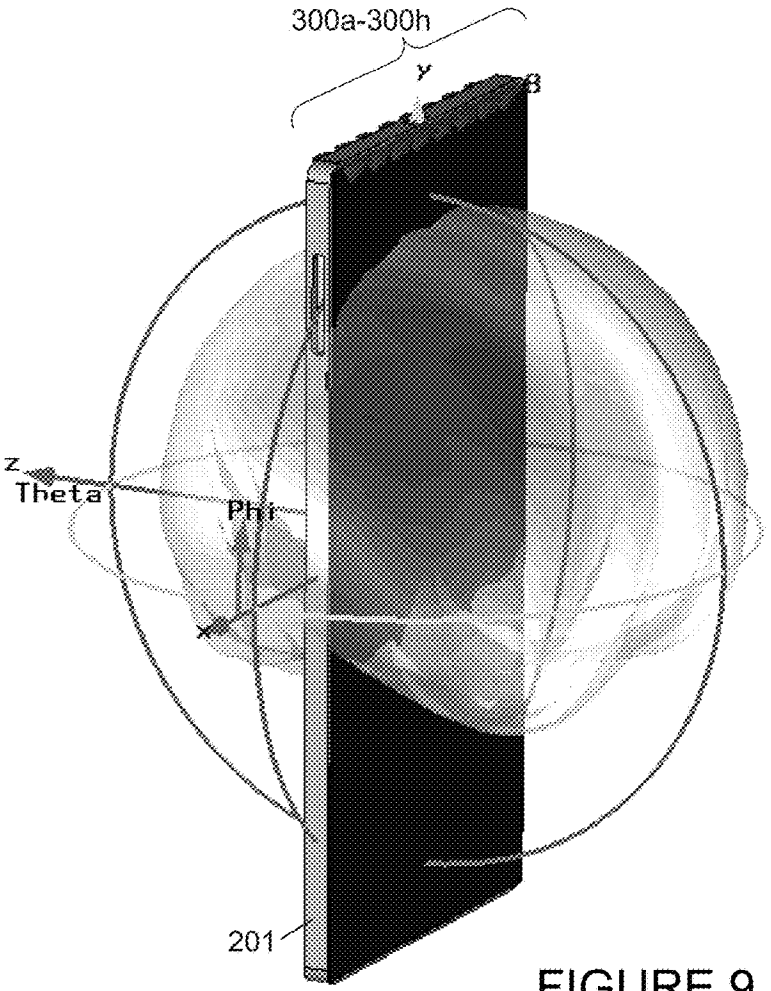
FIG. 9 illustrates the radiation pattern around the mobile device of FIG. 8, according to various embodiments of the present inventive concepts.

Referring now to FIG. 8, an array of IFAs 300*a*-300*h* along an edge of a mobile device 201 is illustrated. FIG. 9 illustrates the radiation pattern around the mobile device of FIG. 8 with an array of IFAs 300*a*-300*h*. The radiation pattern is based on the collective radiation patterns of each of the IFAs 300. Due to the inclusion of choke notches in the IFAs, a uniform radiation pattern with little distortion is present around the mobile device 201.

Figure 10:
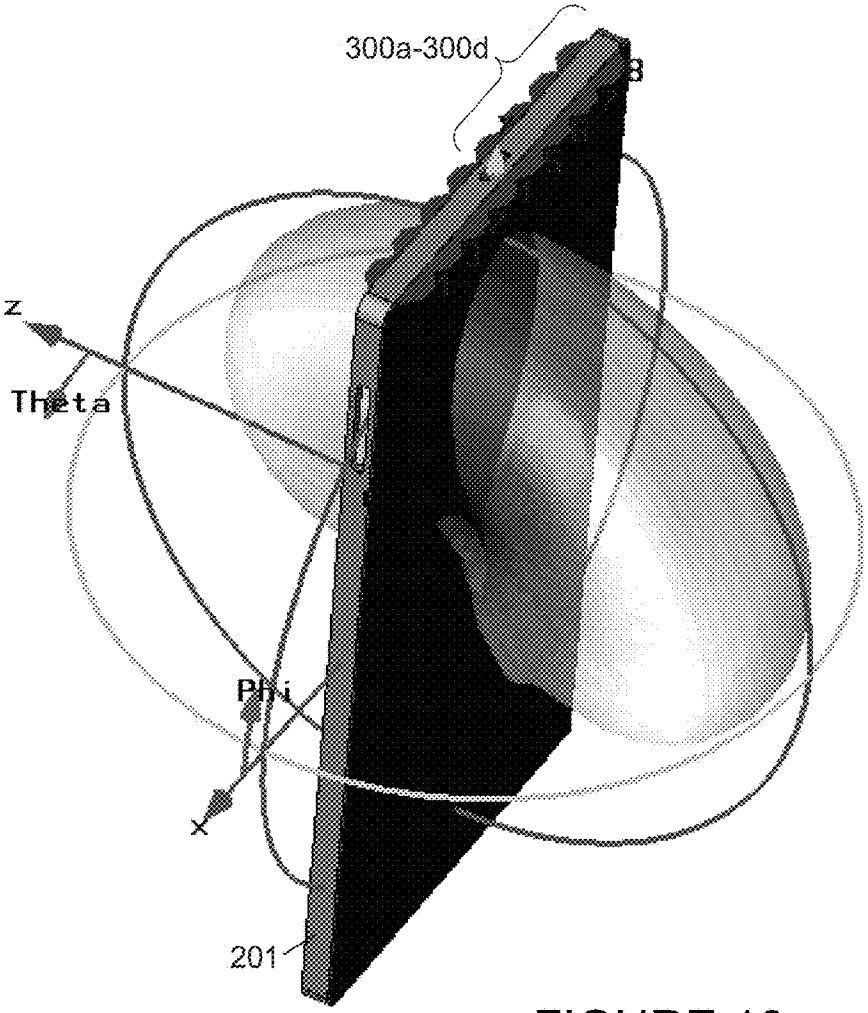
FIG. 10 illustrates the radiation pattern around a mobile device including a 1×4 array of IFAs with choke notches, according to various embodiments of the present inventive concepts.

Referring now to FIG. 10, the radiation pattern around a mobile device 201 including two 1×4 arrays of IFAs with choke notches is illustrated. The 1×4 arrays may serve as MIMO antennas for Wifi, 3G, LTE and/or other communication networks. The radiation pattern is based on the collective radiation patterns of each of the four IFAs 300*a*-300*d*. Due to the inclusion of choke notches in the IFAs, a uniform radiation pattern with little distortion is present around the mobile device 201.

Experimental simulations of an array of IFA with choke notches spaced 0.45 wavelengths apart have yielded improvements in antenna isolation between array elements of around 10 dB. For a 1×4 antenna, the observed worst case coupling between array elements was found to be −17 dB. The resultant antenna radiation patterns of these simulations were broad beams, as illustrated, for example, in FIGS. 9 and 10, suitable for millimeter wave antennas at extremely high frequencies such as 10 to 300 GHz.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device comprising:

an inverted-F antenna (IFA) comprising an IFA exciting element, an IFA feed, and a grounding pin, wherein the IFA exciting element is configured to resonate at a resonant frequency when excited by a signal received through the IFA feed;

a choke notch having a length defined based on the resonant frequency of the IFA exciting element, wherein the choke notch is electrically coupled to the IFA exciting element through the grounding pin; and a ground patch that is electrically coupled between the choke notch and a ground plane, wherein the length of the choke notch corresponds to approximately 0.5 wavelengths of the resonant frequency of the IFA exciting element, and wherein the IFA feed is located near a center of the choke notch, at approximately 0.25 wavelengths of the resonant frequency of the IFA.

2. The wireless electronic device of claim 1, wherein the IFA feed is located near the ground patch.

3. The wireless electronic device of claim 1, wherein the ground patch is electrically connected to the choke notch near a center of the choke notch.

4. The wireless electronic device of claim 1, wherein the IFA feed comprises a conductive stripline.

5. The wireless electronic device of claim 1, wherein the width of the IFA feed on a printed circuit board (PCB) layer is selected based on a thickness of the PCB layer such that the IFA is impedance matched to the IFA exciting element.

6. The wireless electronic device of claim 1, wherein the choke notch is configured to prevent current loops on the ground plane.

7. The wireless electronic device of claim 1, wherein a length of the ground patch is between 0.1 and 0.2 wavelengths of the resonant frequency of the IFA exciting element, and wherein the length of the ground patch determines a bandwidth of the choke notch.

8. The wireless electronic device of claim 1, wherein the grounding pin is electrically conductive and is impedance matched to the IFA exciting element.

9. The wireless electronic device of claim 1, wherein the resonant frequency is a first resonant frequency, and wherein the choke notch is configured to resonate at a second resonant frequency, different from the first resonant frequency.

10. The wireless electronic device of claim 1, wherein the IFA comprises a first IFA, the wireless electronic device further comprising:

one or more additional IFAs each comprising an additional IFA exciting element, an additional IFA feed, an additional grounding pin, and an additional choke notch that is electrically coupled to the additional IFA through the additional grounding pin, wherein the first IFA and the one or more additional IFAs are along an edge of a mobile device.

11. The wireless electronic device of claim 10, wherein a spacing between adjacent ones of the choke notches is between 0.25 wavelengths and 0.5 wavelengths.

12. The wireless electronic device of claim 11, wherein the spacing between adjacent ones of the choke notches is about 0.45 wavelengths.

13. The wireless electronic device of claim 10, wherein the one or more additional IFAs comprise three additional IFAs, and wherein the first IFA and the three additional IFA are configured to receive and/or transmit multiple-input and multiple-output (MIMO) communication.

14. The wireless electronic device of claim 1, wherein the choke notch is configured to prevent current loops on the ground plane.

15. A wireless electronic device comprising:

an inverted-F antenna (IFA) comprising an IFA exciting element, an IFA feed, and a grounding pin, wherein the IFA exciting element is configured to resonate at a resonant frequency when excited by a signal received through the IFA feed;

a choke notch having a length defined based on the resonant frequency of the IFA exciting element, wherein the choke notch is electrically coupled to the IFA exciting element through the grounding pin; and a ground patch that is electrically coupled between the choke notch and a ground plane, a printed circuit board (PCB) comprising a first layer and a second layer, wherein the IFA exciting element, the grounding pin, the choke notch, the ground patch, and the ground plane are co-located on the first layer of the PCB, and wherein the IFA feed is located on the second layer, different from the first layer, of the PCB, and wherein a feeding point on the IFA feed is electrically connected to the IFA by a via contact that extends between the first layer and the second layer of the PCB.

16. A wireless electronic device comprising:

an inverted-F antenna (IFA) comprising an IFA exciting element, an IFA feed, and a grounding pin, wherein the IFA exciting element is configured to resonate at a resonant frequency when excited by a signal received through the IFA feed;

a choke notch having a length defined based on the resonant frequency of the IFA exciting element, wherein the choke notch is electrically coupled to the IFA exciting element through the grounding pin; and a ground patch that is electrically coupled between the choke notch and a ground plane, wherein the IFA is configured to induce current on the choke notch such that a radiation pattern of the wireless electronic device forms a dipole antenna radiation pattern.

* * * * *